US007255256B2

(12) United States Patent
McGee et al.

(10) Patent No.: US 7,255,256 B2
(45) Date of Patent: Aug. 14, 2007

(54) FINISH NAILER WITH CONTOURED CONTACT TRIP FOOT

(75) Inventors: David M. McGee, Attleboro, MA (US); Daniel R. Burgjohann, Coventry, RI (US); Prudencio S. Canlas, Jr., North Kingstown, RI (US); Alexander J. Calvino, Cranston, RI (US); Jonathan Fairbanks, Coventry, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 37 days.

(21) Appl. No.: 11/070,821

(22) Filed: Mar. 3, 2005

(65) Prior Publication Data

US 2006/0196682 A1 Sep. 7, 2006

(51) Int. Cl.
*B25C 1/04* (2006.01)

(52) U.S. Cl. ..... 227/8; 227/119; 227/130; 227/148; D8/68

(58) Field of Classification Search ..... 227/8, 227/130, 148, 119, 120; D8/68
See application file for complete search history.

(56) References Cited

U.S. PATENT DOCUMENTS 2,169,433 A 8/1939 Roy
2,822,544 A 2/1958 Anstett
2,851,689 A * 9/1958 McIlvin ..... 227/156
2,866,199 A 12/1958 Freeman et al.
3,012,247 A 12/1961 Sillars et al.
3,112,488 A 12/1963 Dettloff et al.
3,281,046 A 10/1966 Boulay
3,283,986 A 11/1966 McKee
3,360,176 A 12/1967 Gehl et al.
3,542,273 A 11/1970 Hedrick
3,693,863 A 9/1972 Black
4,187,589 A 2/1980 Jobe, II
4,196,833 A 4/1980 Haytayan
4,252,260 A 2/1981 Burton
4,309,805 A 1/1982 Jacobson
4,332,203 A 6/1982 Flowers
4,452,387 A 6/1984 Haytayan
4,581,964 A * 4/1986 Takatsuru ..... 81/464
4,597,517 A 7/1986 Wagdy
4,907,730 A 3/1990 Dion
5,222,646 A 6/1993 Mukoyama
5,626,274 A 5/1997 Shkolnikov et al.
5,628,445 A 5/1997 Braddock et al.
5,799,856 A 9/1998 Mukoyama
5,810,239 A * 9/1998 Stich ..... 227/119
5,816,469 A 10/1998 Ohuchi
5,842,625 A 12/1998 Kimura (Continued)

*Primary Examiner*—Scott A. Smith
(74) *Attorney, Agent, or Firm*—Pillsbury Winthrop Shaw Pittman LLP

(57) ABSTRACT

A fastener driving device for use in driving a fastener into an elongated contoured portion of a workpiece is disclosed. The elongated contoured portion has a surface that is contoured perpendicular to a longitudinal direction of the elongated contoured portion. The device includes a contact arm that is operatively connected with the trigger assembly, and a contoured contact foot for engaging the workpiece. The contact arm is constructed and arranged to move relative to a housing assembly of the driving device when the contact foot is pressed against the workpiece. The contact foot has a contoured engaging surface that includes a recess that is shaped to generally complement the shape of the contoured surface of the workpiece.

14 Claims, 11 Drawing Sheets

U.S. PATENT DOCUMENTS 5,873,510 A 2/1999 Hirai et al.
5,996,874 A * 12/1999 Fukushima et al. ..... 227/8
6,095,392 A 8/2000 Batts, Jr. et al.
6,131,787 A 10/2000 Curtis
6,155,472 A 12/2000 Deziel
6,161,744 A 12/2000 Mukoyama et al.
6,209,770 B1 4/2001 Perra
6,286,742 B1 9/2001 Mukoyama
6,318,620 B1 11/2001 Anstett et al.
6,343,730 B2 2/2002 Benes et al.
6,450,389 B1 9/2002 Clouse
6,585,141 B2 7/2003 Goss et al.
6,592,016 B2 7/2003 Hamano et al.
6,609,646 B2 * 8/2003 Miller et al. ..... 227/8
6,622,901 B2 9/2003 Hamano et al.
6,631,836 B2 10/2003 Dickhaut
6,679,413 B2 1/2004 Miller et al.
6,708,860 B1 3/2004 Thieleke
6,726,080 B2 4/2004 Hamada
6,776,322 B2 8/2004 Villela et al.
6,789,718 B2 9/2004 Canlas et al.
7,070,079 B2 * 7/2006 Smolinski et al. ..... 227/8
2003/0024962 A1 2/2003 Sims et al.
2003/0192931 A1 10/2003 Miller et al.
2003/0230621 A1 12/2003 Yamamoto et al.
2004/0020966 A1 2/2004 Miller et al.
2004/0050899 A1 3/2004 Canlas et al.
2005/0194421 A1 9/2005 Smolinski et al.

* cited by examiner

FINISH NAILER WITH CONTOURED CONTACT TRIP FOOT

BACKGROUND OF THE INVENTION

1. Field of the Invention

The present invention is generally related to fastener driving devices, and more particularly to a contact trip foot for fastener driving devices.

2. Description of Related Art

Typical pneumatic fastener driving tool actuation is achieved via the displacement of a "contact arm," or "contact trip" through contact with a work surface, in combination with a user/operator "trigger." The contact arm is typically constructed of stamped steel or formed wire, thereby producing an otherwise resilient member allowed to travel axially with the intended fastener driving direction, and generally adjacent to or in proximity of a "nose" of the tool through which the fastener is driven. A molded rubber covering called a "trip foot" is frequently affixed to the contact arm. The trip foot is usually removable and is intended to protect softer substrates from developing depressions as a result of direct contact with the relatively hard contact arm. The nose is typically of a geometry that forms a complete or nearly complete channel through which a fastener is guided by nature of the restrictive walls of the channel. While the channel walls provide guidance of the fastener, they also tend to obscure from view of the operator the exact location of the fastener upon exiting the nose. Further, the proximity of the contact arm to the nail exit region of the nose often contributes to this obscurity. Additionally, the trip foot may obscure the view even more.

In many applications that employ pneumatic fastener driving tools, a high degree of fastener placement accuracy is desired. Fastener placement may effect the structural integrity of a fastened joint, or significantly influence the appearance quality of cosmetically sensitive applications, such as millwork trim. Additionally, proper installation of millwork may require fasteners to be driven into irregular geometries, such as into grooves or onto raised features. It is often regarded as difficult to accurately place fasteners in these types of applications, because the contact arm and the trip foot are often shaped to engage primarily flat surfaces. Also, the cosmetically sensitive nature of most millwork materials encourages the use of the trip foot so as to reduce incidental scuffing or marking of these surfaces. The trip foot, as previously described, may reduce the operator's ability to accurately place a fastener in these applications, thereby increasing the chance of such scuffing or marking.

FIG. 1 illustrates a nail driving tool 100' with an adapter 20' that is attached to a contact arm 110' for driving nails into a floorboard 40', as disclosed by U.S. Pat. No. 6,286,742. As shown in FIG. 2, the adapter 20' has a projection 22' that is substantially V-shaped. This allows the tool to drive a nail into a root corner 41*a'* of the floorboard 40', as shown in FIG. 1. As shown in FIG. 2, the tip 22*a'* of the protrusion 22' falls along a nail driving axis 16' in the nail driving direction P'. Although such a tool may be useful in flooring applications, e.g. when a nail is desired to be driven into an intersection of two substantially perpendicular surfaces, it would not be useful for driving nails into any other geometry, as the tip 22*a'* of the protrusion 22' would have the tendency to slip off of the workpiece, thereby potentially scuffing the workpiece.

BRIEF SUMMARY OF THE INVENTION

In an embodiment of the invention, a fastener driving device for use in driving a fastener into an elongated contoured portion of a workpiece is provided. The elongated contoured portion of the workpiece has a surface that is contoured in a direction perpendicular to a longitudinal direction of the elongated contoured portion. The fastener driving device includes a housing assembly that has a fastener drive track defined therein, a fastener driver reciprocally mounted for movement within the drive track, and a power operated system constructed and arranged to be actuated so as to move the fastener driver through successive operative cycles. Each cycle includes a drive stroke in which a fastener in the drive track is driven into a workpiece, and a return stroke. The fastener driving device also includes an actuating mechanism that includes a contact trip assembly and a trigger assembly constructed and arranged to actuate the power operated system in response to a predetermined cooperative movement between the contact trip assembly and the trigger assembly. The contact trip assembly includes a contact arm operatively connected with the trigger assembly and has a contoured contact foot for engaging the workpiece. The contact arm is constructed and arranged to move relative to the housing assembly when the contoured contact foot is pressed against the workpiece. The contoured contact foot has a contoured engaging surface that includes a recess that is shaped to generally complement the shape of the contoured surface of the workpiece.

In an embodiment, a fastener driving device for use in driving a fastener into an elongated contoured portion of a workpiece is provided. The elongated contoured portion has a surface that is contoured in a direction perpendicular to a longitudinal direction of the elongated contoured portion. The fastener driving device includes a housing assembly that has a fastener drive track defined therein, a fastener driver reciprocally mounted for movement within the drive track, and a power operated system constructed and arranged to be actuated so as to move the fastener driver through successive operative cycles. Each cycle includes a drive stroke in which a fastener in the drive track is driven into a workpiece, and a return stroke. The fastener driving device also includes an actuating mechanism that includes a contact trip assembly and a trigger assembly constructed and arranged to actuate the power operated system in response to a predetermined cooperative movement between the contact trip assembly and the trigger assembly. The contact trip assembly includes a contact arm operatively connected with the trigger assembly and has a contoured contact foot for engaging the workpiece. The contact arm is constructed and arranged to move relative to the housing assembly when the contoured contact foot is pressed against the workpiece. The contoured contact foot has a contoured, gently curved convex engaging surface that is shaped to generally complement the shape of the contoured surface of the workpiece such that when the contoured contact foot is pressed against the contoured surface of the workpiece, the engagement between the gently curved convex engaging surface and the workpiece (1) gently locates the contoured contact foot relative to the workpiece in the direction perpendicular to the longitudinal direction, and (2) allows the contoured contact foot to rotate about a pivot axis substantially parallel to the longitudinal direction. The gently curved convex engaging surface is aligned with the drive axis in a direction parallel to the longitudinal direction.

In an embodiment, a contoured contact foot for a fastener driving device for use in driving a fastener into an elongated contoured portion of a workpiece is provided. The elongated contoured portion has a surface that is contoured in a direction perpendicular to a longitudinal direction of the elongated contoured portion. The contoured contact foot is constructed and arranged to be connected to a contact trip arm of the fastener driving device. The contoured contact foot has a contoured engaging surface that includes a recess that is shaped to generally complement the shape of the contoured surface of a workpiece.

In an embodiment, a contoured contact foot for a fastener driving device for use in driving a fastener into an elongated contoured portion of a workpiece is provided. The elongated contoured portion has a surface that is contoured in a direction perpendicular to a longitudinal direction of the elongated contoured portion. The contoured contact foot is constructed and arranged to be connected to a contact trip arm of the fastener driving device. The contoured contact foot has a contoured, gently curved convex engaging surface that is shaped to generally complement the shape of the contoured surface of a workpiece such that when the contoured contact foot is pressed against the contoured surface of the workpiece, the engagement between the gently curved convex engaging surface and the workpiece (1) gently locates the contoured contact foot relative to the workpiece in the direction perpendicular to the longitudinal direction, and (2) allows the contoured contact foot to rotate about a pivot axis substantially parallel to the longitudinal direction. The gently curved convex engaging surface is aligned with a drive axis of the fastener driving device when contoured contact foot is connected to the contact trip arm.

In an embodiment, a combination of a fastener driving device for use in driving a fastener into an elongated contoured portion of a workpiece, and a plurality of contoured contact foot members is provided. The elongated contoured portion of the workpiece has a surface that is contoured in a direction perpendicular to a longitudinal direction of the elongated contoured portion. The fastener driving device includes a housing assembly that has a fastener drive track defined therein, a fastener driver reciprocally mounted for movement within the drive track, and a power operated system constructed and arranged to be actuated so as to move the fastener driver through successive operative cycles. Each cycle includes a drive stroke in which a fastener in the drive track is driven into a workpiece, and a return stroke. The fastener driving device also includes an actuating mechanism that includes a contact trip assembly and a trigger assembly constructed and arranged to actuate the power operated system in response to a predetermined cooperative movement between the contact trip assembly and the trigger assembly. The contact trip assembly includes a contact arm operatively connected with the trigger assembly at one end. The contact arm is constructed and arranged to move relative to the housing assembly when the contoured contact foot is pressed against the workpiece. Each contoured contact foot member is constructed and arranged to be removably connected to the contact arm at an end opposite the trigger assembly. Each contoured contact foot member has a different contoured engaging surface that is shaped to complement the shape of different contoured surfaces of the workpiece. The contoured engaging surface of one or more of the plurality of contoured contact foot members includes a recess.

In an embodiment, a method for driving a fastener into an elongated contoured portion of a workpiece with a fastener driving device is provided. The fastener driving device includes a housing assembly, a power operated system, and an actuating mechanism that includes a contact arm, a contoured contact foot connected to the contact arm, and a trigger assembly. The elongated contoured portion of the workpiece has a surface that is contoured in a direction perpendicular to a longitudinal direction of the elongated contoured portion. The contoured contact foot has a contoured engaging surface that includes a recess that is shaped to complement the shape of the contoured surface of the workpiece. The method includes engaging the recess of the contact foot with the complementary contoured surface of the workpiece so that the complementary shapes of the engagement prevent slippage of the contoured contact foot relative to the workpiece in the direction perpendicular to the longitudinal direction, and actuating the power operated system to drive the fastener by (1) pressing the contoured contact foot against the workpiece so that the contact arm moves relative to the housing assembly, and (2) moving a trigger of the trigger assembly from an inoperative position to an operative position.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE INVENTION

Figure 1:
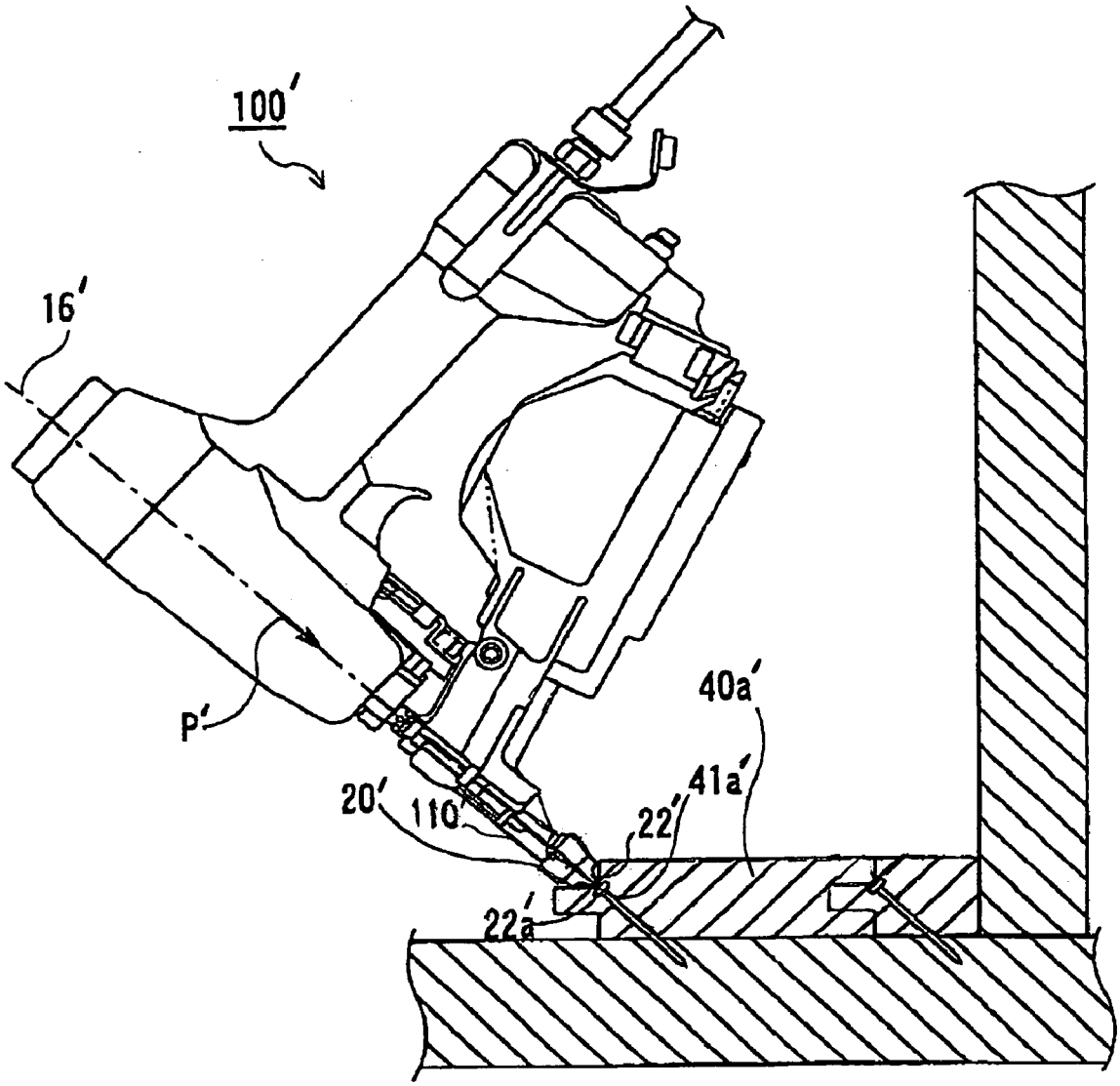
FIG. 1 (PRIOR ART)
FIG. 1 is a side view of a prior art nail driving tool that is driving a nail into a root corner of a floorboard.
Figure 2:
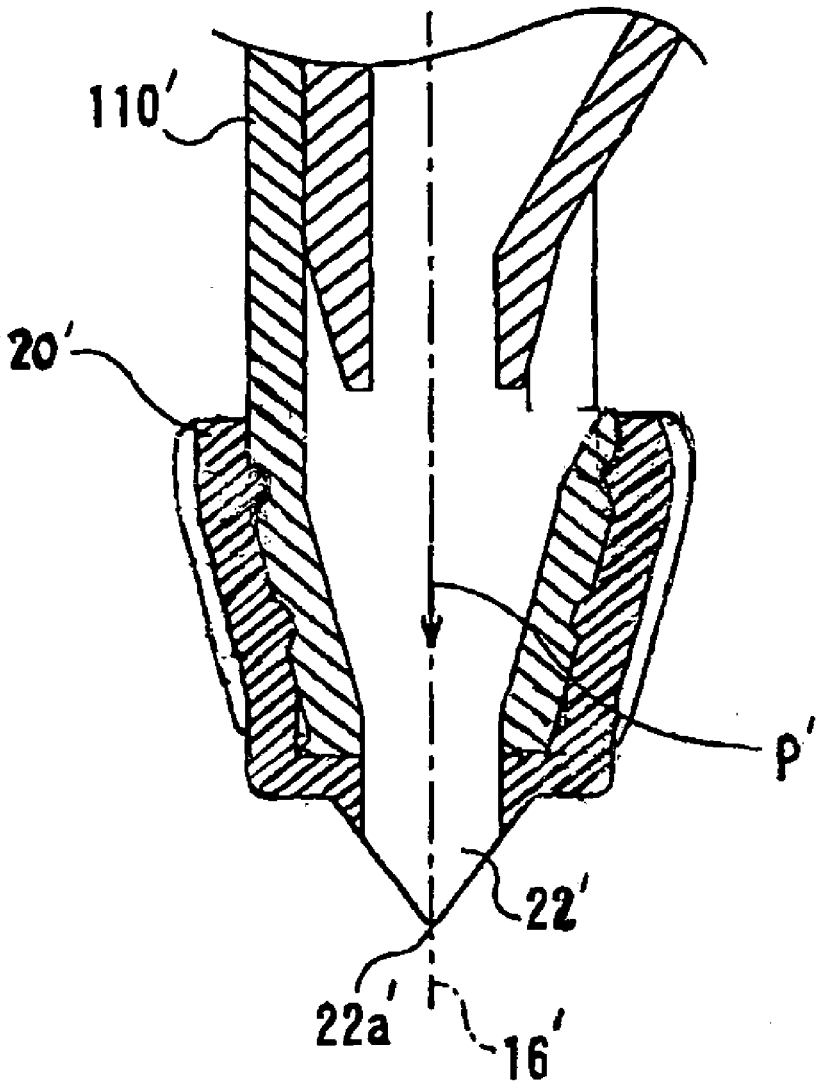
FIG. 2 (PRIOR ART)
FIG. 2 is a cross-sectional view of an adapter shown attached to the nail driving tool of FIG. 1.
Figure 3:
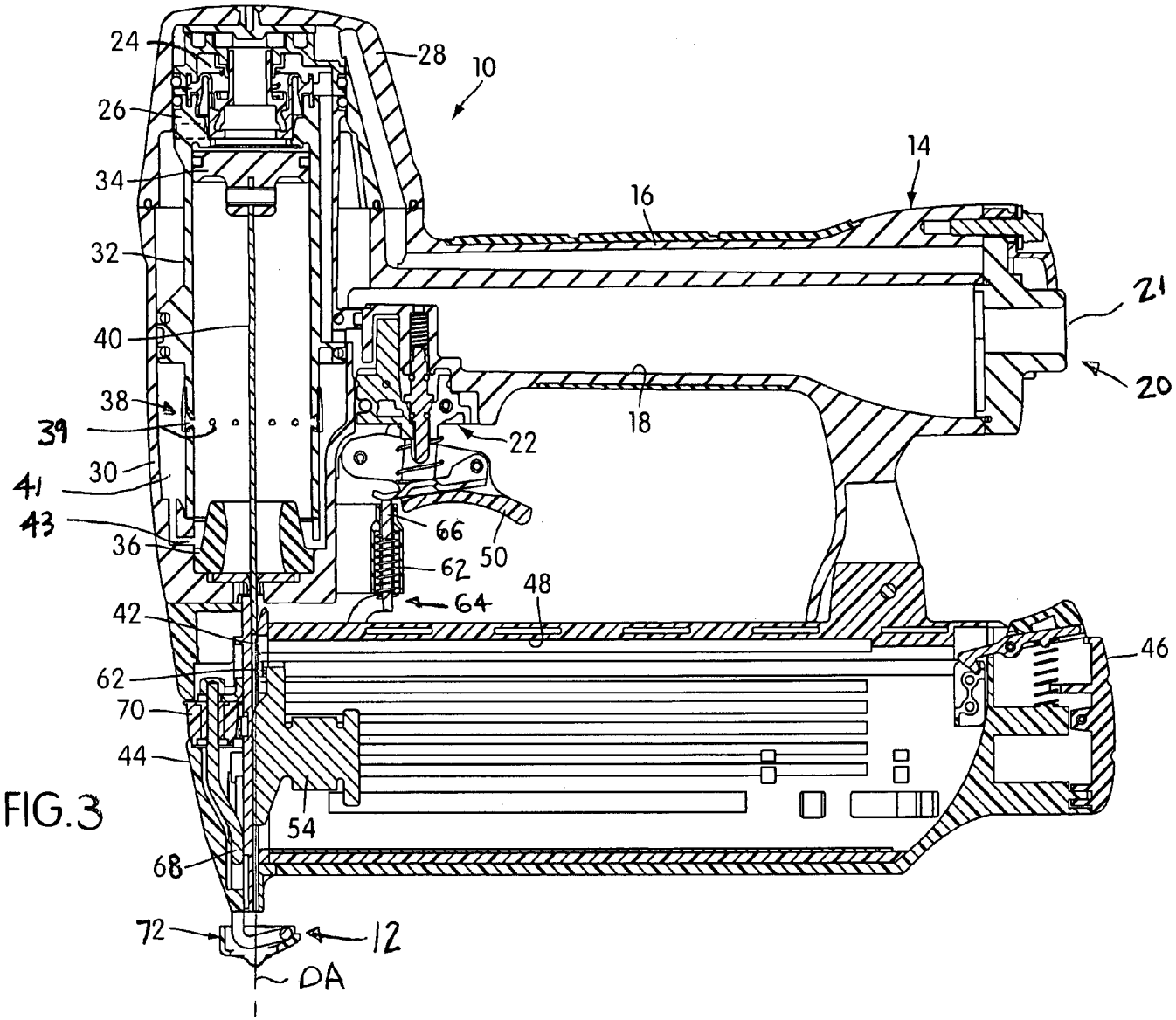
FIG. 3 is a cross-sectional side view of a fastener driving device according to an embodiment of the invention.

Referring now more particularly to the drawings, there is shown in FIG. 3 a fastener driving device, generally indicated at 10, embodying the principles of the present invention. The invention is particularly concerned with the construction and operation of a contact trip assembly, generally indicated at 12, embodied in the fastener driving device 10, and its interaction with a workpiece 200 (shown in FIGS. 10*a*-13) into which a fastener is to be driven. The contact trip assembly 12 is discussed in further detail below.

The fastener driving device 10 itself may be of any type. As shown, the fastener driving device 10 is power operated. Such power operation may be of any type, such as electrical, internal combustion, or pneumatic. The fastener driving device 10 as shown in FIG. 3 is a typical pneumatically powered unit.

Specifically, the pneumatically powered fastener driving device 10 shown in FIG. 3 includes a portable housing or frame assembly, generally indicated at 14. The portable housing assembly 14 includes a handle section 16, which is hollow so as to define a pneumatic reservoir 18. An end cap 20 that is provided with an opening 21 enables a source of air under pressure (not shown) to be communicated with the reservoir 18.

The reservoir 18 communicates with a manually operable trigger valve assembly 22, which controls the communication of the reservoir to a pilot pressure chamber 24 of a main valve assembly 26. The main valve assembly 26 is housed within a cap assembly 28, fixed to the top of a main housing section 30, that is integral with and extending generally perpendicular to the handle section 16, both of which form parts of the portable housing assembly 14.

Mounted within the main housing section 30 is a cylinder 32, an upper end of which cooperates with the main valve assembly 26 to enable the main valve assembly 26 to function in the usual fashion when in an inoperative position, wherein the pilot pressure chamber 24, under the control of trigger valve assembly 22 in its inoperative position, is communicated with the reservoir 18. When in its inoperative position, the main valve assembly 26 also functions to communicate the open upper end of the cylinder 32 with atmosphere through the cap assembly 28. An adjustable exhaust assembly, such as the assembly described by U.S. Pat. No. 6,431,429, which is incorporated herein by reference, may also be associated with the cap assembly 28 to further communicate air within the device 10 to atmosphere.

When the trigger valve assembly 22 is manually moved from its inoperative position into an operative position, the pilot pressure chamber 24 is shut off from communication with the reservoir 18 and communicated with atmosphere. The pressure from the reservoir 18 then acts upon the main valve assembly 26 to move it from its inoperative position into an operative position. In its operative position, the main valve assembly 26 functions to shut off the communication of the open upper end of the cylinder 32 with the atmosphere and to allow full peripheral communication thereof with the reservoir 18. A more detailed description of the operation of the trigger valve assembly is provided by U.S. Pat. No. 6,431,429, which is incorporated herein by reference.

Communication of the reservoir 18 with the open upper end of the cylinder 32 serves to drive a piston 34, slidably mounted within the cylinder 32, through a fastener drive stroke, which is completed when the piston 34 engages a shock absorbing bumper 36 mounted in the main housing section 30 below the lower end of the cylinder 32, which is fixed therein.

The drive stroke of the piston 34 constitutes one stroke of a two stroke cycle of movement that the piston 34 undergoes on a successive basis in accordance with the manual actuating movement of the trigger valve assembly 22. The other stroke of the piston 34, which constitutes a return stroke, is accomplished by a suitable return system 38. The return system may be of any type. As shown, the return system 38 is of the air plenum chamber type that includes one-way check valve openings 39 that extend through the cylinder 32 into a surrounding plenum chamber 41, also known as a plenum, formed between the exterior of the cylinder 32 and the interior of the main housing section 30.

The drive stroke of the piston 34 serves to move a fastener driver 40 connected therewith through a drive stroke within a drive track 42 formed within a nose piece assembly 44 fixed below the lower end of the main housing section 30, and forming a part of the portable housing assembly 14. The drive track 42 is substantially aligned with a drive axis DA. The drive stroke of the fastener driver 40 serves to drive a leading fastener from a supply of fasteners contained within a fastener magazine assembly 46 that has been laterally moved into the drive track 42 along a feed track 48 defined by the magazine assembly 46. As the piston 34 moves toward the end of the drive stroke, the check valve openings 39 are uncovered and the air under pressure in the cylinder 32 driving the piston 34 is allowed to enter into the plenum chamber 41. The lower end of the plenum chamber 41 is communicated by an opening 43 into the bottom of the cylinder 32 at the level of the bumper 36.

The bumper 36 is engaged by the lower surface of the piston 34 at the end of the drive stroke and is arrested thereby. As soon as the pressure in the cylinder 32 is relieved by the movement of the main valve assembly 26, the air pressure within the cylinder 32 is communicated with an outlet opening provided by the main valve assembly 26 communicating the air pressure within the cylinder 32 with an adjustable exhaust assembly. As soon as the air pressure is relieved, the air pressure which is contained in the plenum chamber 41 acts on the lower end of the piston 34 so as to effect a return stroke thereof. The air within the cylinder 32 displaced by the movement of the piston 34 through its return stroke is discharged through the outlet opening into the adjustable exhaust assembly and, from there, into the atmosphere.

The magazine assembly 46, which is fixed to the nose piece assembly 44 and extends below and is fixed to the handle section 16, may be of any type. The magazine assembly 46, as shown, is a conventional side loader that is capable of handling fasteners in a stick formation supply, as shown, or a coil formation supply of any configuration.

The trigger valve assembly 22 is manually actuated by an actuating mechanism which includes a trigger assembly 50 and the contact trip assembly 12. A complete actuation movement serves to move the trigger valve assembly 22 from its inoperative position into its operative position by the coordinated movement of the trigger assembly 50 and contact trip assembly 12, both of which may be of any conventional construction so as to require any coordination to effect operation. In the illustrated embodiment, actuation requires a specific sequential movement. That is, the cooperation between the trigger assembly 50 and the contact trip assembly 12 is such that the trigger valve assembly 22 will be moved from its inoperative position into its operative position only when the contact trip assembly 12 is first moved against the workpiece 200 and into its operative position and, thereafter, the trigger assembly 50 is manually moved into its operative position. Of course, the invention is not limited to devices that operate sequentially. For example, the device 10 may be configured so that the trigger assembly 50 may be manually moved from its inoperative position into its operative position before the contact trip assembly 12 is moved against the workpiece 200 into its operative position. Any sequence of moving the trigger assembly 50 and the contact trip assembly 12 between their respective inoperative positions to their operative positions to enable the trigger valve assembly 22 to move into its operative position is contemplated.

In the broadest aspects of the present invention, the device 10 may be adapted to handle any fastener configuration. However, in the embodiment shown, the feed track 48 is configured to receive therein a supply of finishing nail fasteners in stick formation. The magazine assembly 46 includes a pusher 54, the illustrated embodiment of which is shown as a sheet metal structure having a width slightly greater than the diameter of the finishing nails. The pusher 54 is slidably mounted in the feed track 48 and is spring-biased to move in a direction toward the drive track 42. Of course, in embodiments that include a coil type magazine assembly, a pawl and reciprocating piston of a conventional design may be used to feed the fasteners from the feed track 48 to the drive track 42. The illustrated embodiment is not intended to be limiting in any way.

The contact trip assembly 12, in addition to its biasing spring, which is shown at 62 in FIG. 3, may be of non-adjustable one-piece construction, however, as shown, the contact trip assembly 12 provides for adjustment of the depth of penetration of the fastener into the workpiece 200 during the drive stroke of the fastener driver 40. As best shown in FIG. 3, the contact trip assembly 12 includes a contact arm 64 that is operatively connected to the trigger assembly 50 at one end. As shown, the contact arm 64 may include an upper portion 66 and a lower portion 68 that is operatively connected to the upper portion 66 with an adjustable connection 70. The adjustable connection 70 allows the lower portion 68 to be positioned relative to the upper portion 66, thereby providing the adjustment of depth of penetration of the fastener into the workpiece 200.

Figure 4:
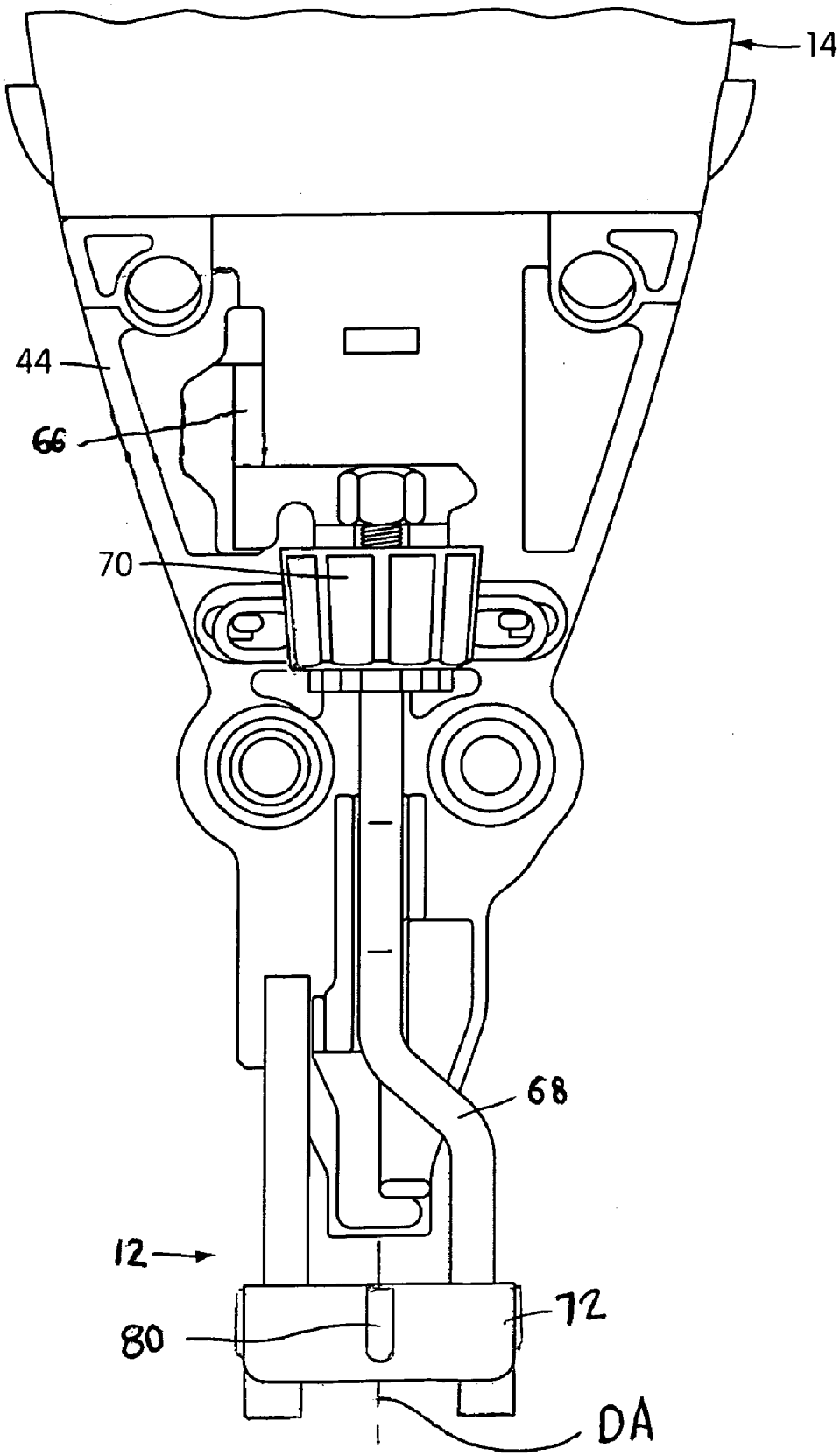
FIG. 4 is a partial front view of the fastener driving device of FIG. 2.

As shown in greater detail in FIG. 4, the contact trip assembly 12 also includes a contoured contact foot 72 that is connected to the lower portion 68 of the contact arm 64. The contoured contact foot 72 may be an integral part of the contact arm 64. Preferably, the contoured contact foot 72 is removably mounted to the contact arm 64 so that it may be removed from the contact arm 64 and exchanged with a contoured contact foot of another embodiment of the invention, as will be discussed in further detail below.

The contoured contact foot 72 may be constructed from any material, including metal, rubber, or plastic, or any combination thereof. Preferably, the contoured contact foot 72 is molded from a plastic or rubber material that is rigid enough to withstand thousands of placements on workpieces, yet flexible enough to be able to be slightly deformed so that the contoured contact foot 72 may be connected to the contact arm 64, as would be understood by one of ordinary skill in the art, and explained in further detail below.

As shown in FIGS. 10*a*-13, the workpiece 200 includes an elongated contoured portion 202. The elongated contoured portion 202 is elongated in a longitudinal direction that runs into and out of the page so that the workpiece 200 is shown in cross-section relative to the longitudinal direction. The elongated contoured portion 202 has a contoured surface 204 that is contoured in a direction perpendicular to the longitudinal direction of the elongated contoured portion 202.

Figure 5:
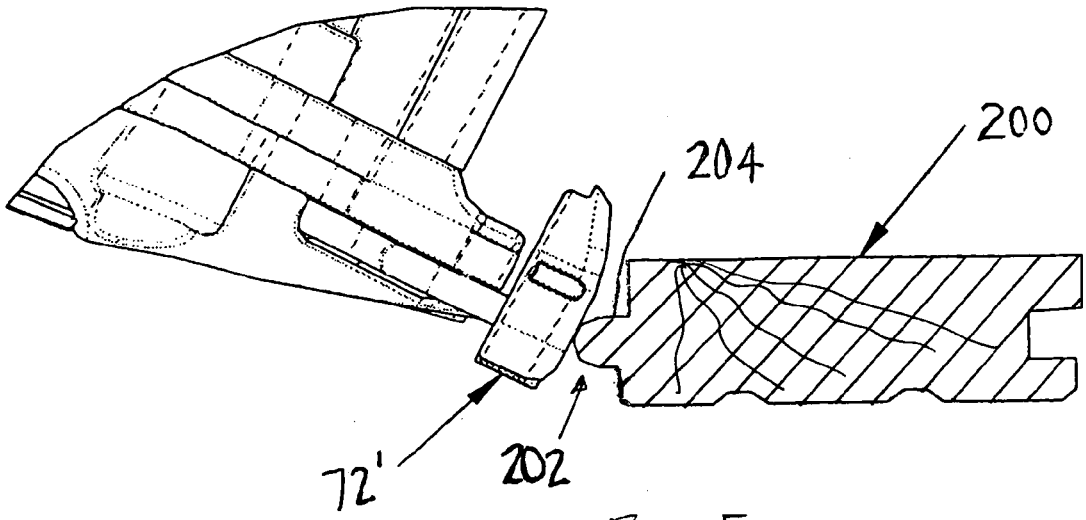
FIG. 5 (PRIOR ART)
FIG. 5 is a partial side view of a conventional fastener driving device as it contacts a contoured surface of a workpiece.
Figure 6:
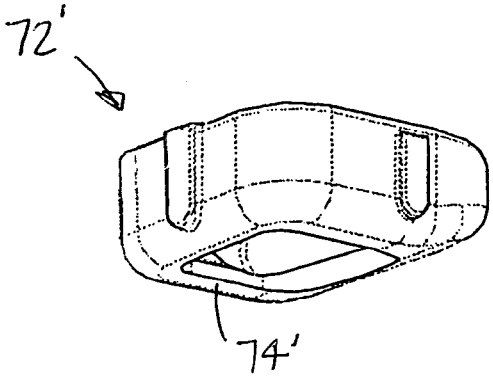
FIG. 6 (PRIOR ART)
FIG. 6 is a bottom perspective view of a contact foot of the fastener driving device of FIG. 5.
Figure 7:
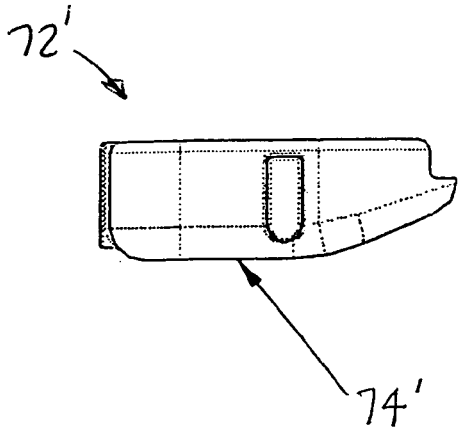
FIG. 7 (PRIOR ART)
FIG. 7 is a side view of the contact foot of FIG. 6.

A conventional contact foot 72' is shown in FIGS. 5-7. As shown in FIG. 7, the conventional contact foot 72' has a bottom surface 74' that is substantially flat. Such a design is ideal when the target for the fastener to be driven by the fastener driving device 10 lies in a substantially flat surface. However, when the conventional contact foot 72' is used to drive a fastener into the contoured surface 204 of the workpiece 200, the accuracy of the actual location of the driven fastener, as compared to the target location, may be compromised. This may be caused by the slipping of the conventional contact foot 72' in all directions relative to the contoured surface 204 before the fastener is driven, or during the driving event.

Figure 8:
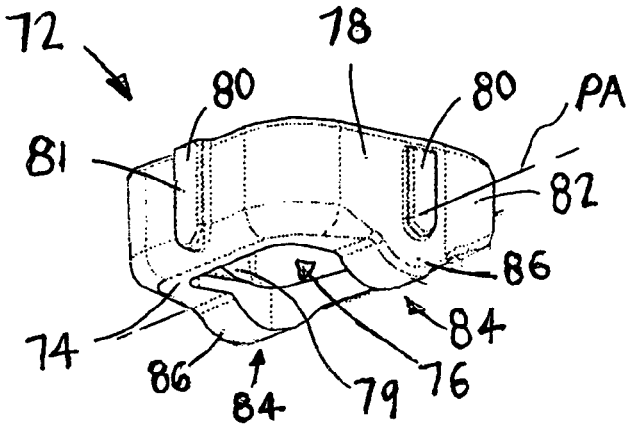
FIG. 8 is a bottom perspective view of an embodiment of a contoured contact foot of the fastener driving device of FIG. 3.
Figure 10A:
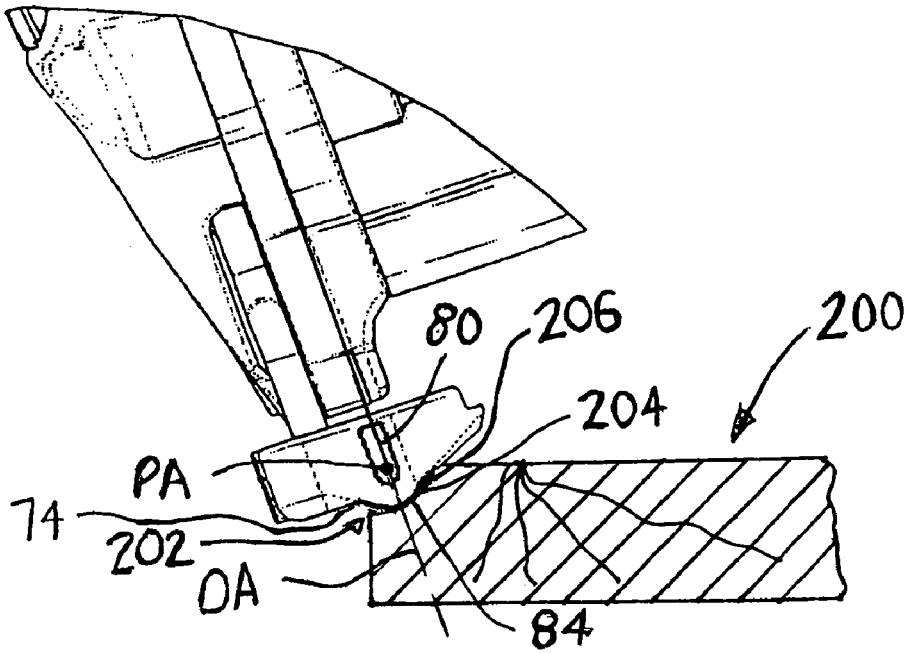
FIG. 10*a* is a partial side view of the fastener driving device of FIG. 3 as it contacts an embodiment of a contoured surface of a workpiece.

In an embodiment of the invention, as shown in FIG. 8, the contoured contact foot 72 includes a bottom surface 74 that substantially surrounds an opening 76. As shown in FIG. 10*a*, the bottom surface 74 faces the workpiece 200 when the device 10 is pressed against the workpiece 200 during operation thereof. The opening 76 is sized so that the nose piece assembly 44 is partially received by the opening 76 when the device is pressed against the workpiece 200. As explained above, pressing the device 10 against the workpiece 200 causes the contact trip assembly 12 to move relative to the device 10, thereby causing the nosepiece 44 to move downward, relative to the contoured contact foot 72. In one embodiment, the lower end surface of the nosepiece 44 does not reach the lower end of the opening 76, so that the nosepiece 44 will not contact the workpiece 200. Instead, the nosepiece 44 may have a structure that engages a portion of the contoured contact foot 72 to prevent further relative movement of the nosepiece 44. In another embodiment, the lower surface of the nosepiece 44 is allowed to contact the workpiece 200.

A side wall 78 extends upwardly from the bottom surface 74 so that it also surrounds the opening 76. The side wall 78 may include a plurality of alignment markers 80 on an outside surface 82 thereof that are positioned to indicate the position of the exit of the drive track 42. The alignment markers 80 may assist the user in locating the device 10 at the desired location on the workpiece 200, as the alignment markers 80 are substantially parallel to the drive axis DA of the drive track 42, and indicate the location of the drive axis DA relative to the rest of the contact foot 72. An inside surface 79 of the side wall 78 may include recesses and/or protrusions that complement the shape of the end of the lower portion 68 of the contact arm 64 so that the contoured contact foot 72 may snugly receive the end of the contact arm 64. This way, the contoured contact foot 72 should not separate from the contact arm 64 during normal use of the device 10, yet still be removable by the user when the user would like to change out the contoured contact foot 72.

Figure 9:
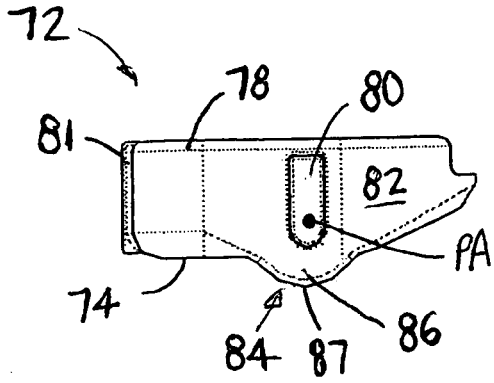
FIG. 9 is a side view if the contoured contact foot of FIG. 8.

As shown in FIGS. 8 and 9, the bottom surface 74 of the contoured contact foot 72 includes an engaging surface 84. The engaging surface 84 is the portion of the bottom surface 74 that actually engages the contoured portion 202 of the workpiece 200, as shown in FIGS. 10*a*-12*b*. The engaging surface 84 is shaped to generally complement the shape of the contoured surface 204 of the workpiece 200, so that when the contact trip assembly 12 is pressed against the contoured surface 204 of the workpiece 200, the engagement between the complementary, contoured surfaces of the contoured contact foot 72 and of the workpiece 200 prevent slippage of the contoured contact foot 72 relative to the workpiece 200 in the direction perpendicular to the longitudinal direction. This may substantially enhance the accuracy of the placement of the fastener into the contoured surface 204 of the workpiece 200.

The actual profile of the engaging surface 84 will depend on the intended application. For example, in the embodiments illustrated in FIGS. 8-12*b*, the engaging surface 84 includes a pair of protrusions 86, one on either side of the opening 76, that extend outward from the rest of the bottom surface 74. Although two protrusions 86 are shown, it is contemplated that in an embodiment, only one protrusion 86 may be provided. The illustrated embodiments are not intended to be limiting in any way. As illustrated, the protrusions 86 provide a gently curved convex engaging surface 84 that is aligned with the drive axis DA in a direction parallel to the longitudinal direction. This allows the contoured contact foot 72 to pivot about a pivot axis PA, as best shown in FIGS. 10*a* and 10*b*, that is substantially parallel to the longitudinal direction of the elongated workpiece 200, intersects the drive axis DA, and is spaced apart from the engaging surface 84.

As shown in FIG. 9, the alignment marker 80 located on a side of the contoured contact foot 72 preferably passes through the pivot axis PA and points to an apex 87 of the protrusion 86. This way, the alignment marker 80, the pivot axis PA, and the apex 87 of the gently contoured convex engaging surface 84 are aligned along an axis that is substantially parallel to the drive axis DA, thereby further assisting in the precise placement of the fastener into the workpiece 200. The alignment marker 80 in the front of the contoured contact foot 72, indicated at 81, may be used to align the drive axis DA along the longitudinal direction of the workpiece 200. Preferably, the gently curved convex shape has a constant radius that extends between the pivot axis PA and the engaging surface 84, although it is contemplated that the radius may vary along the gently curved convex surface, while still allowing the contoured contact foot 72 to pivot about the pivot axis PA.

Figure 10B:
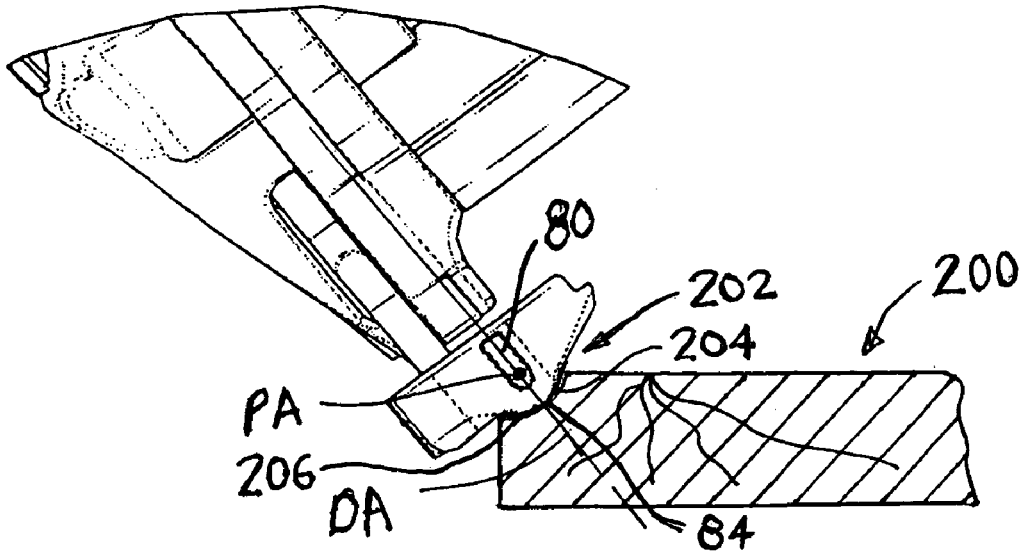
FIG. 10*b* is a partial side view of the fastener driving device of FIG. 10*a* after it has been rotated about a pivot axis.

As shown in FIGS. 10*a* and 10*b*, this embodiment of the contoured contact foot 72 may be used to drive a fastener into a workpiece 200 that includes a contoured surface 204 in the shape of a gently curved recess or groove 206, such as a workpiece 200 used in molding applications. By providing a contoured contact foot 72 with a gently curved convex engaging surface 84 and a pivot axis PA that intersects the drive axis DA, the contact foot 72 may be pivoted about the pivot axis PA so that the fastener may be driven into a more precise location, as illustrated by the different locations of the drive axis DA in FIGS. 10*a* and 10*b*. As explained above, the alignment marker 80 may be used to assist in locating the precise entry point of the fastener, because the alignment marker 80 is substantially parallel to the drive axis DA, as illustrated in the Figures.

Figure 11A:
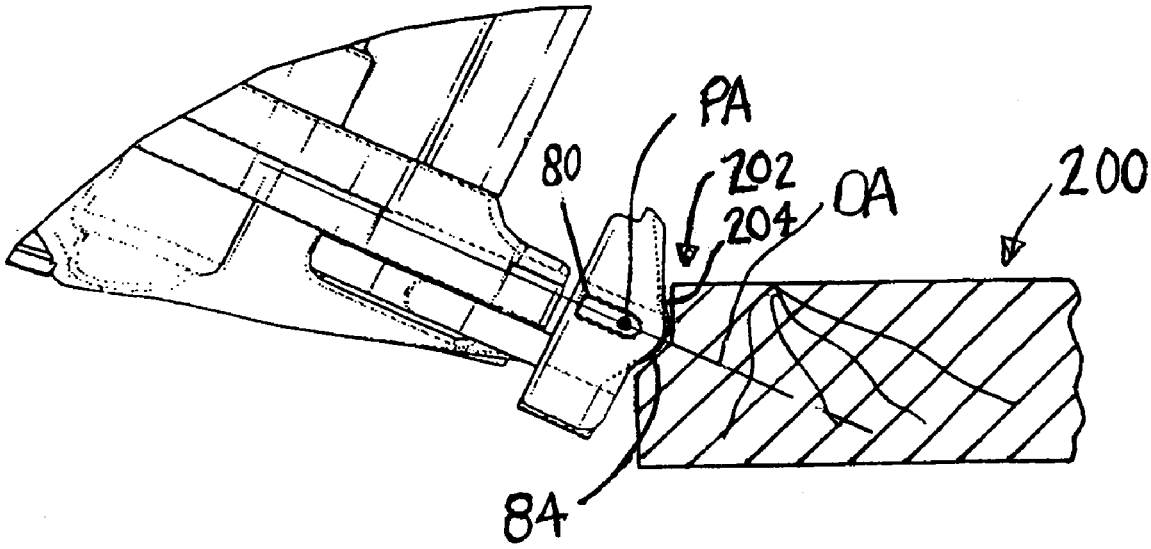
FIG. 11*a* is a partial side view of the fastener driving device of FIG. 3 as it contacts another embodiment of a contoured surface of the workpiece.
Figure 11B:
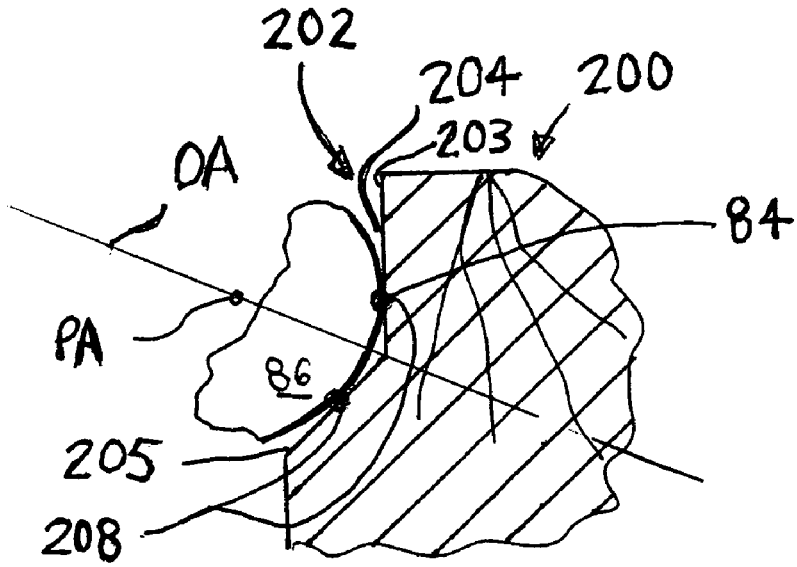
FIG. 11*b* is a detailed view of FIG. 11*a* showing the interaction between the contoured contact foot and the contoured surface.

As shown in FIGS. 11*a* and 11*b*, this embodiment of the contoured contact foot 72 may be used to drive a fastener into a workpiece 200 with a contoured surface 204 that may be defined by two intersecting surfaces 203, 205 that define an obtuse angle therebetween. As shown in greater detail in FIG. 11*b*, the engaging surface 84 of the protrusion 86 engages the contoured surface 204 of the workpiece at two points 208, one on each of the intersecting surfaces 203, 205. As shown, the pivot axis PA and each of the contacting points 208 are spaced away from the intersection of the two surfaces 203, 205 such that the engaging surface 84 of the protrusion 86 is spaced away from the intersection, i.e. the engaging surface 84 does not actually contact the intersection. The contoured contact foot 72 may be pivoted about the pivot axis PA to locate the drive axis DA at the intersection of the two surfaces 203, 205, as shown in the Figures. Alternatively, the drive axis DA may be aligned with another part of the contoured surface 204, so that the fastener may be driven at any point along either of the surfaces 203, 205.

Figure 12A:
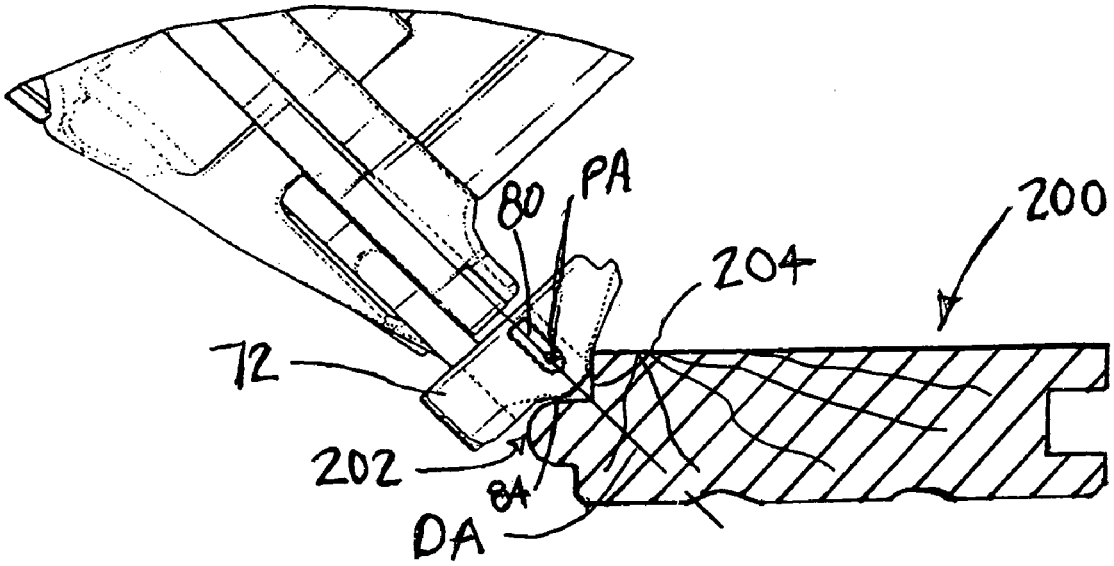
FIG. 12*a* is a partial side view of the fastener driving device of FIG. 3 as it contacts another embodiment of a contoured surface of the workpiece.
Figure 12B:
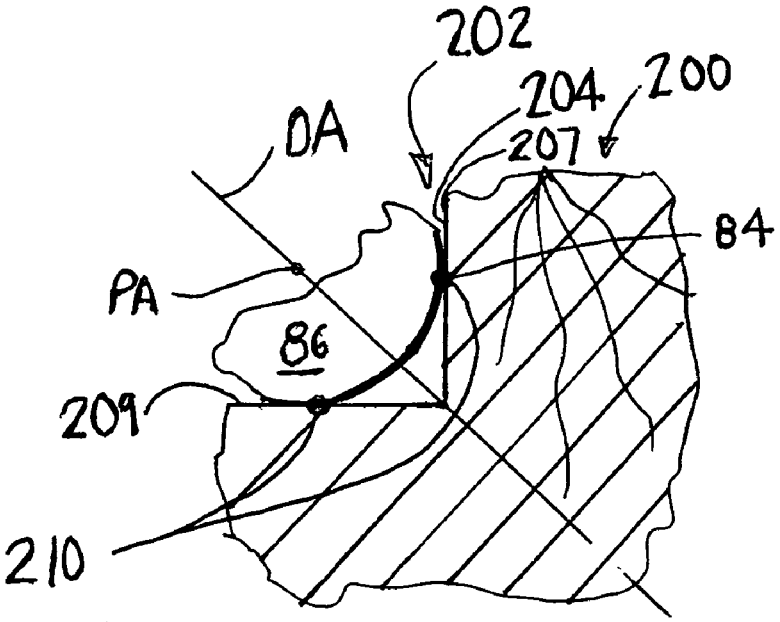
FIG. 12*b* is a detailed view of FIG. 12*a* showing the interaction between the contoured contact foot and the contoured surface.

As shown in FIGS. 12*a* and 12*b*, this embodiment of the contoured contact foot 72 may also be used to drive fasteners into a workpiece 200 having a contoured surface 204 that includes two surfaces 207, 209 that intersect at an angle of about 90°, and are, hence, substantially perpendicular to each other. Although the workpiece 200 shown in FIGS. 12*a* and 12*b* is a piece of tongue-and-groove type flooring, it is understood that the workpiece 200 may be of any type that includes a recess or groove with a similar geometry, such as millwork or molding. As shown in greater detail in FIG. 12*b*, the engaging surface 84 of the protrusion 86 contacts the contoured surface 204 of the workpiece 200 at two points 210, one on each of the intersecting surfaces 207, 209. As shown, the pivot axis PA and each of the contacting points 210 are spaced away from the intersection of the two surfaces 207, 209 such that the engaging surface 84 of the protrusion 86 is spaced away from the intersection, i.e. the engaging surface 84 does not actually contact the intersection. The contoured contact foot 72 may be pivoted about the pivot axis PA to locate the drive axis DA at the intersection of the two surfaces 207, 209, as shown in the Figures. Alternatively, the drive axis DA may be aligned with another part of the contoured surface 204, so that the fastener may be driven at any point along either of the surfaces 207, 209. As shown in the Figures, the alignment marker 80 may be used to further assist the user with a more precise placement of the fastener into the intersection of the two surfaces 207, 209, if desired.

Figure 13:
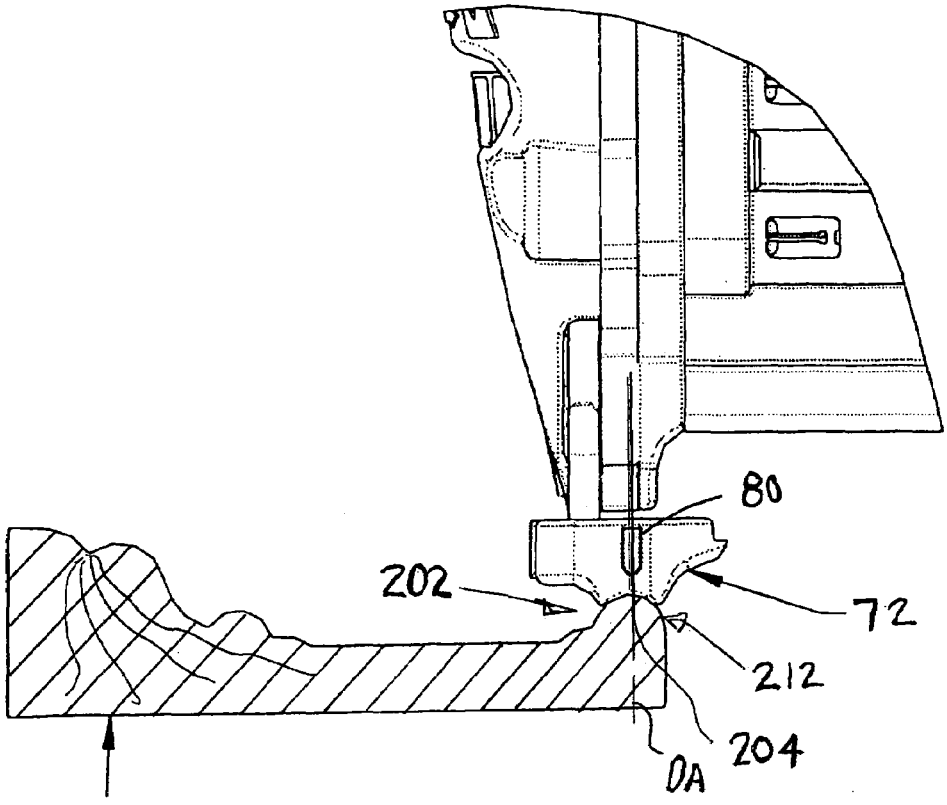
FIG. 13 is a partial side view of another embodiment of a fastener driving device of the present invention as it contacts a contoured surface of a workpiece.
Figure 14:
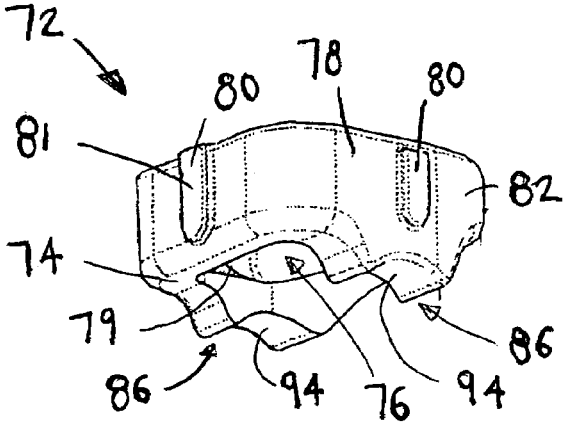
FIG. 14 is a bottom perspective view of a contoured contact foot of the fastener driving device of FIG. 13.
Figure 15:
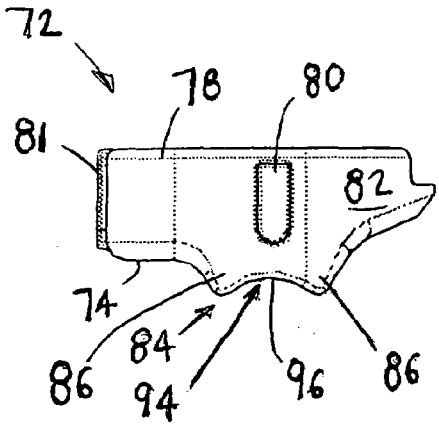
FIG. 15 is a side view of the contoured contact foot of FIG. 14.
Figure 16:
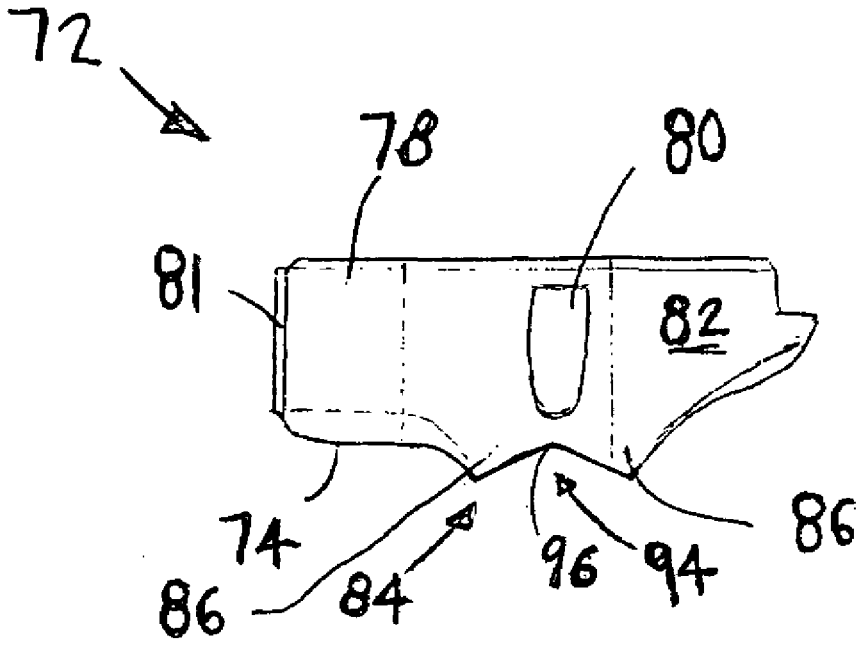
FIG. 16 is a side view of another embodiment of the contoured contact foot of FIG. 15.
Figure 17:
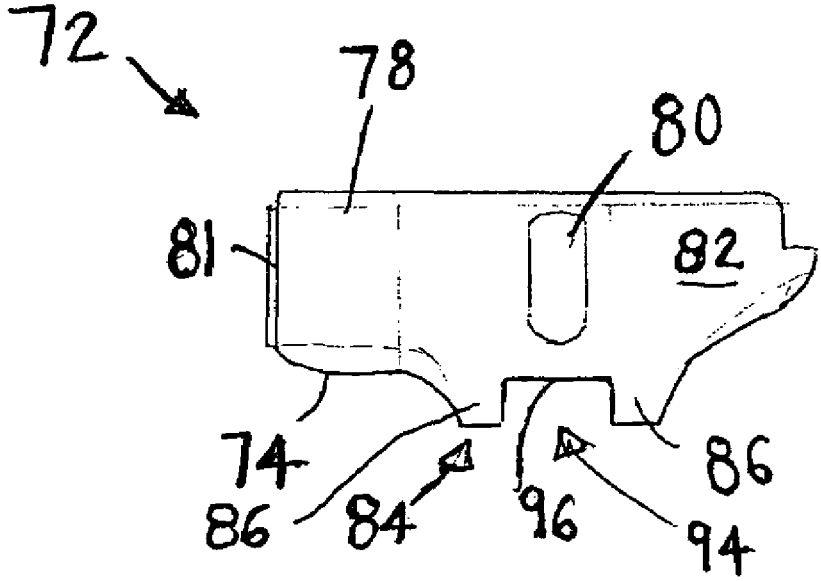
FIG. 17 is a side view of another embodiment of the contoured contact foot of FIG. 15.

In another embodiment of the contoured contact foot 72, illustrated in FIGS. 13-17, the engaging surface 84 includes a pair of protrusions 86 on each side of the opening 76, and a recess 94 disposed between each pair of protrusions 86. The recess 94 may have a substantially concave shape, as shown in FIGS. 13-15, a substantially V-type shape, as shown in FIG. 16, or a substantially rectangular shape, as shown in FIG. 17. The specific shapes shown in the figures are not intended to be limiting in any way. The recess 94 enables the device 10 to be used in millwork or molding applications in which the surface to receive the fastener has a protruding surface 212, such as a convex surface shown in FIG. 13. The workpiece 200 in FIG. 13 may be millwork or trim molding, such as a chair rail, crown molding, a baseboard, or any other type of molding. As shown in the Figures, one of the alignment markers 80 is located to coincide with a bottom 96 of the recess 94, to further assist the user with a more precise placement of the fastener into the contoured surface 204 the workpiece 200, as discussed above.

With all of the embodiments of the invention disclosed herein, by providing a contoured engaging surface 84 on the contoured contact foot 72 that complements the target contoured surface 204 on the workpiece 200, the user may be able to receive tactile feedback when the device is properly positioned in a least two degrees of freedom. Such feedback may increase the speed at which successive fasteners may be driven.

In an embodiment, a combination of the fastener driving device 10 with a plurality of interchangeable contoured contact foot members 72 is provided. The interchangeable contoured contact foot members 72 may include any combination of the contoured contact foot members 72 disclosed herein, including the conventional contact foot 72' illustrated in FIGS. 6 and 7. This way, the same device 10 may be used to drive fasteners into workpieces with different profiles. This may improve the flexibility of the fastener driving device 10, as it may now be used for accurately driving fasteners into a plurality of different types of workpieces.

In operation, a fastener may be driven into the elongated contoured portion 202 of the workpiece 200 with the fastener driving device 10 described above by engaging the complementary contoured surfaces of the contoured contact foot 72 and the workpiece 200 so that the complementary shapes of the engagement prevent slippage of the contoured contact foot 72 relative to the workpiece 200 in the direction perpendicular to the longitudinal direction of the workpiece 200. Once the surfaces are engaged, the power operated system of the fastener driving device 10 may be actuated by (1) pressing the fastener driving device 10 against the workpiece 200 so that the contact arm 64 moves relative to the fastener driving device 10, and (2) moving the trigger 50 from the inoperative position to the operative position, as described above. The actuation of the power system may be completed in either order, i.e., the trigger 50 may me moved before pressing the device 10 against the workpiece 200, or the device 10 may be pressed against the workpiece 200 before the trigger 50 is moved from the inoperative position to the operative position.

The descriptions above are intended to be illustrative, not limiting. Thus, it will be apparent to one skilled in the art that modifications may be made to the invention as described without departing from the scope of the claims set out below.

What is claimed is:

1. A fastener driving device for use in driving a fastener into a target location on an elongated contoured portion of a workpiece, wherein the elongated contoured portion has a surface that is contoured in a direction perpendicular to a longitudinal direction of the elongated contoured portion, the fastener driving device comprising:

a housing assembly having a fastener drive track defined therein;

a fastener driver reciprocally mounted for movement within said drive track along a drive axis;

a power operated system constructed and arranged to be actuated so as to move the fastener driver through successive operative cycles, each cycle comprising a drive stroke wherein a fastener in said drive track is driven into a workpiece, and a return stroke; and an actuating mechanism comprising a contact trip assembly and a trigger assembly constructed and arranged to actuate said power operated system in response to a predetermined cooperative movement between said contact trip assembly and said trigger assembly, wherein said contact trip assembly comprises a contact arm operatively connected with said trigger assembly and having a contoured contact foot for engaging the workpiece, said contact arm being constructed and arranged to move relative to the housing assembly when said contoured contact foot is pressed against said workpiece, said contoured contact foot having a contoured, gently curved convex engaging surface shaped to generally complement the shape of the contoured surface of the workpiece such that when the contoured contact foot is pressed against the contoured surface of the workpiece, the engagement between the gently curved convex engaging surface and the workpiece (1) generally locates the contoured contact foot relative to the workpiece in the direction perpendicular to the longitudinal direction, and (2) allows the contoured contact foot to rotate about a pivot axis that is substantially parallel to the longitudinal direction, the pivot axis being spaced apart from the gently curved convex engaging surface; and wherein said gently curved convex engaging surface is aligned with the drive axis in a direction parallel to said longitudinal direction.

2. A fastener driving device according to claim 1, wherein said contoured contact foot is integral with said contact arm.

3. A fastener driving device according to claim 1, wherein said contoured contact foot is removably connected to said contact arm so that said contoured contact foot may be removed from the contact arm.

4. A fastener driving device according to claim 1, wherein the pivot axis of the contoured contact foot intersects the drive axis of the drive track.

5. A fastener driving device according to claim 1, wherein said contoured contact foot further comprises alignment markers that assist with aligning said drive track to the target location on said contoured surface of said workpiece, said alignment markers being substantially parallel to the drive axis.

6. A fastener driving device according to claim 1, wherein said contoured contact foot further comprises a second gently curved convex engaging surface, and said first and second convex engaging surfaces are disposed on opposite sides of an opening in said contoured contact foot through which the fastener is driven.

7. A fastener driving device according to claim 1, wherein the engagement between the complementary contoured surfaces inhibits slippage of the contoured contact foot relative to the workpiece in a direction along the longitudinal direction only as a function of friction between the contoured surfaces, as there is no form-locking relationship between the contoured surfaces in the longitudinal direction.

8. A fastener driving device according to claim 1, wherein the power operated system is pneumatic.

9. A fastener driving device according to claim 1, wherein the gently curved convex engaging surface is defined by a constant radius that extends between the pivot axis and the gently curved convex engaging surface.

10. A contoured contact foot for a fastener driving device for use in driving a fastener into a target location on an elongated contoured portion of a workpiece, wherein the elongated contoured portion has a surface that is contoured in a direction perpendicular to a longitudinal direction of the elongated contoured portion, said contoured contact foot being constructed and arranged to be connected to a contact trip arm of the fastener driving device, said contoured contact foot having a contoured, gently curved convex engaging surface that is shaped to generally complement the shape of the contoured surface of a workpiece, the gently curved convex engaging surface being shaped such that when the contoured contact foot is pressed against the contoured surface of the workpiece, the engagement between the gently curved convex engaging surface and the workpiece (1) gently locates the contoured contact foot relative to the workpiece in the direction perpendicular to the longitudinal direction, and (2) allows the contoured contact foot to rotate about a pivot axis substantially parallel to the longitudinal direction the pivot axis being spaced apart from the gently curved convex engaging surface, wherein the gently curved convex engaging surface is aligned with a drive axis of the fastener driving device when contoured contact foot is connected to the contact trip arm.

11. A contoured contact foot according to claim 10, wherein the pivot axis intersects the drive axis when the contoured contact foot is connected to the contact trip arm.

12. A contoured contact foot according to claim 10, further comprising alignment markers that assist with aligning the drive track of the fastener driving device to the target location on said contoured surface of said workpiece when the contoured contact foot is connected to the contact trip arm, said alignment markers being substantially parallel with the drive track.

13. A contoured contact foot according to claim 10, further comprising a second gently curved convex engaging surface, and said first and second engaging surfaces are disposed on opposite sides of an opening in said contoured contact foot through which the fastener is driven.

14. A contoured contact foot according to claim 10, wherein the gently curved convex engaging surface is defined by a constant radius that extends between the pivot axis and the gently curved convex engaging surface.

* * * * *